US006482139B1

(12) United States Patent
Haag

(10) Patent No.: US 6,482,139 B1
(45) Date of Patent: Nov. 19, 2002

(54) EXERCISE APPARATUS

(76) Inventor: Stanley Haag, 135 Crosstown Blvd., Apt. 10, Chaska, MN (US) 55318

( * ) Notice: Subject to any disclaimer, the term of this patent is extended or adjusted under 35 U.S.C. 154(b) by 0 days.

(21) Appl. No.: 09/477,976

(22) Filed: Jan. 5, 2000

Related U.S. Application Data

(60) Provisional application No. 60/116,172, filed on Jan. 18, 1999.

(51) Int. Cl.[7] ..... A63B 21/02

(52) U.S. Cl. ..... 482/121; 482/142

(58) Field of Search ..... 482/121–123, 482/142, 907, 908, 127, 138, 130, 137, 125, 126, 129, 148

(56) References Cited

U.S. PATENT DOCUMENTS

| | | | | | |
|---|---|---|---|---|---|
| 4,072,309 | A | | 2/1978 | Wilson | |
| 4,492,375 | A | * | 1/1985 | Connelly | 482/138 |
| 4,582,320 | A | | 4/1986 | Shaw | |
| 4,634,127 | A | * | 1/1987 | Rockwell | 482/138 |
| 4,635,934 | A | | 1/1987 | Roethke | |
| 5,058,888 | A | * | 10/1991 | Walker et al. | 272/130 |
| 5,176,603 | A | * | 1/1993 | Hundley et al. | 482/140 |
| 5,387,171 | A | * | 2/1995 | Casey | 482/130 |
| 5,456,644 | A | | 10/1995 | Hecox et al. | |
| 5,549,530 | A | * | 8/1996 | Fulks | 482/100 |
| 5,733,229 | A | * | 3/1998 | Dalebout et al. | 482/96 |
| 6,004,247 | A | * | 12/1999 | Webber | 482/100 |

* cited by examiner

*Primary Examiner*—Michael A. Brown
*Assistant Examiner*—Lori Baker Amerson
(74) *Attorney, Agent, or Firm*—Patterson, Thuente, Skaar & Christensen

(57) ABSTRACT

A multiple purpose exercise apparatus has a rigid exercise frame, a universal attachment arm, a multi-exercise arm unit, a bench unit, a leg unit, and a leg exercise unit. The exercise apparatus utilizes elastomer bands to provide the resistance necessary to perform the strength training exercises. The exercise frame provides a sturdy base having a plurality of attachment apertures to which the bench and exercise units attach. The attachment apertures allow for small incremental adjustments of the positions of the bench and exercise units to accommodate a wide range of users and exercises. The universal attachment arm releasably and pivotally attaches to the exercise frame and provides for easy attachment of various exercise components. The multi-exercise arm unit attaches to the universal attachment art and allows the user to conveniently perform press-bar or butterfly exercises without having to change exercise components. The bench unit is highly adjustable to accommodate a wide range of users and exercises and attaches to the exercise frame. The leg unit, also highly adjustable, attaches at the front of the exercise frame and is generally used to support the bench unit and the leg exercise unit.

15 Claims, 3 Drawing Sheets

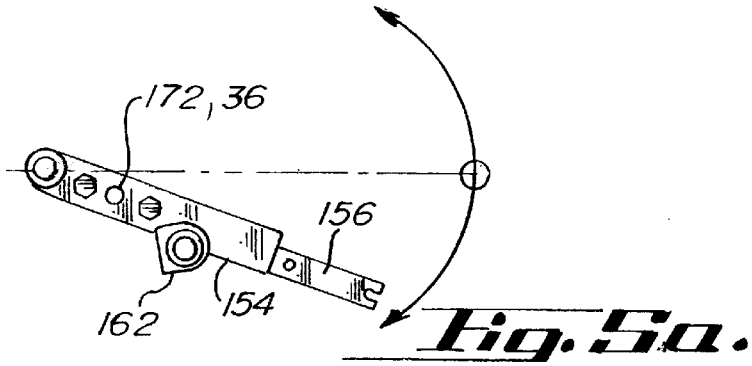
Fig. 5a.
Fig. 5b.
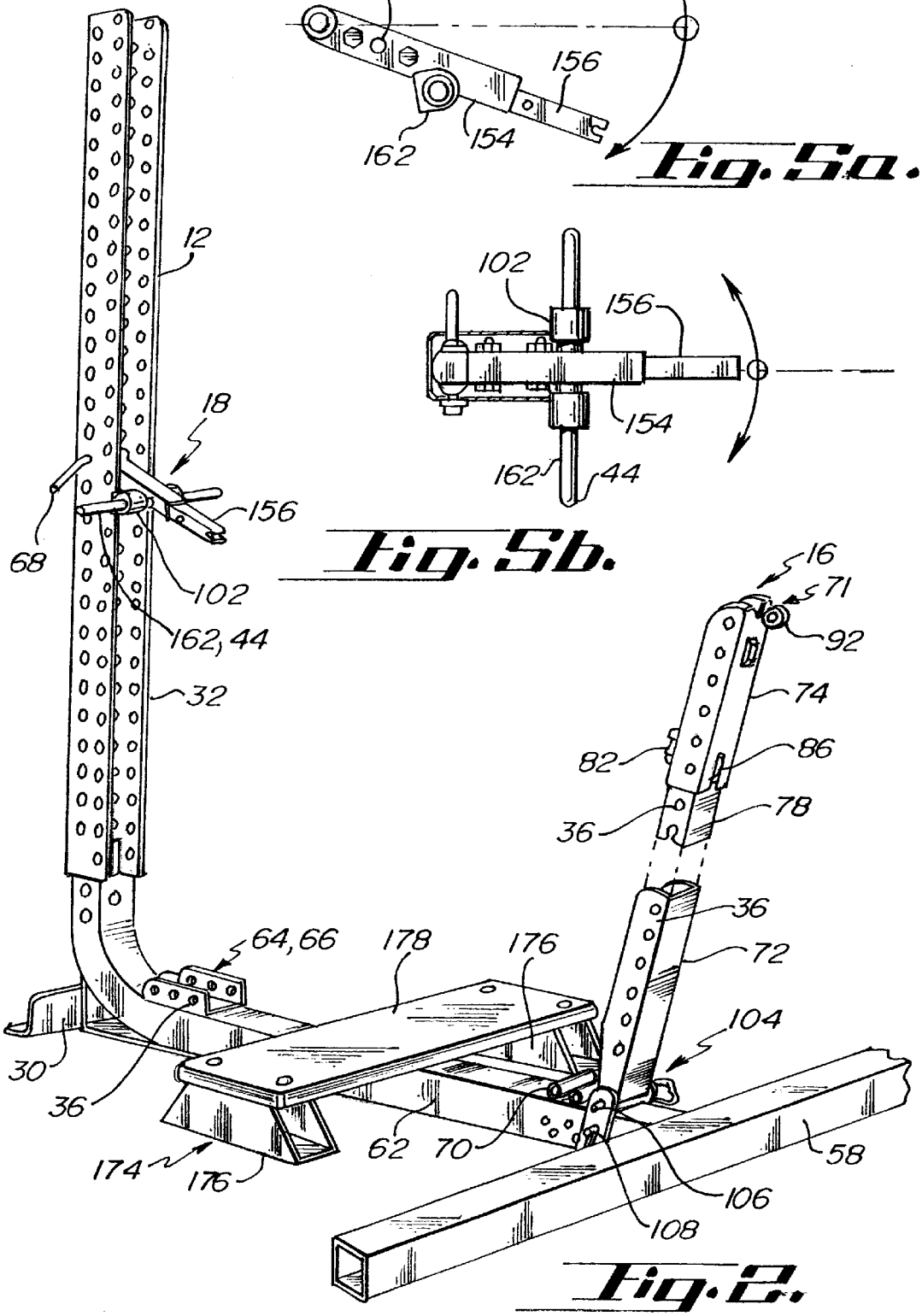
Fig. 2.

EXERCISE APPARATUS

This application is based on U.S. Provisional Patent Application Serial No. 60/116,172 filed Jan. 18, 1999 and which is hereby incorporated by reference.

BACKGROUND OF THE INVENTION

The present invention relates to resistance machines for exercise, more particularly, machines that utilize elastomeric bands.

The prior art is replete with examples of exercise machines utilizing various means for presenting the necessary resistance needed to perform strength training exercises. These include free weights, stacked weights, torsion resistance mechanisms, and elastomer bands.

Exercise devices utilizing elastomer bands are very popular. Currently, equipment such as is shown in U.S. Pat. No. 4,072,309 to Wilson, is quite popular. One drawback with existing elastomer band equipment is that such equipment utilizes separate press-bar and butterfly units. As a result, it is difficult to quickly change from an exercise which utilizes the press-bar component to an exercise which utilizes butterfly component, a common occurrence during a workout routine. In addition, the press-bar component only provides flexing movement of the bar in a vertical arc. Although this makes the exercise using the press-bar component more similar to free weights, it fails to provide a range of flex in the horizontal plane which would make the exercise more parallel with its free weight counterpart.

Additional problems with the prior art involve the instability of the ground support frame and the limited range of adjustments that the bench and leg units are capable of moving through. The instability of the machine leads to unsafe conditions and limits some of the exercises one is capable of performing with it. The lack of adjustments of the bench and leg units present problems in configuring the machine to optimize the chosen exercise and to provide the most comfort to the exerciser.

SUMMARY OF THE INVENTION

A multiple purpose exercise apparatus has a rigid exercise frame, a universal attachment arm, a multi-exercise arm unit, a bench unit, a leg unit, and a leg exercise unit. The exercise apparatus utilizes elastomer bands to provide the resistance necessary to perform the strength training exercises. The exercise frame provides a sturdy base having a plurality of attachment apertures to which the bench and exercise units attach. The attachment apertures allow for small incremental adjustments of the positions of the bench and exercise units to accommodate a wide range of users and exercises. The universal attachment arm releasably and pivotally attaches to the exercise frame and provides for easy attachment of various exercise components. The multi-exercise arm unit attaches to the universal attachment art and allows the user to conveniently perform press-bar or butterfly exercises without having to change exercise components. The bench unit is highly adjustable to accommodate a wide range of users and exercises and attaches to the exercise frame. The leg unit, also highly adjustable, attaches at the front of the exercise frame and is generally used to support the bench unit and the leg exercise unit. The leg exercise unit is designed to accommodate a wide range of users and may be used for various leg exercises.

A feature and advantage of an embodiment of the invention is that the exercise frame provides a very sturdy base which is not susceptible to tipping over backwards.

Another feature and advantage of an embodiment of the invention is that redundant elements of exercise components are eliminated.

Another feature and advantage of an embodiment of the invention is that attachment of various exercise components is made easier allowing the user to quickly move from one exercise to another when a change of the exercise component being used is required.

Another feature and advantage of an embodiment of the invention is that the user can move from an exercise utilizing a press-bar to an exercise utilizing a butterfly motion without changing the exercise component.

Another feature and advantage of an embodiment of the invention is that the press-bar configuration has a more free weight-like feel due to the bar's ability to swing in both the vertical and horizontal planes.

Another feature and advantage of an embodiment of the invention it that the user can comfortably move into a bench press position that will work a more full range of motion.

Another feature and advantage of an embodiment of the invention is that it can be adjusted to accommodate a wide range of users and exercises.

Another feature and advantage of an embodiment of the invention is that the leg unit is highly adjustable thereby providing comfort to a wide range of users.

Another feature and advantage of an embodiment of the invention is that the leg pads of the leg unit can be easily removed and replace allowing for further adjustment of the leg unit.

BRIEF DESCRIPTION OF THE DRAWINGS

FIG. 2 is a perspective view of the exercise frame, support post, and platform according to an embodiment of the invention.

FIG. 5*a* is a side plan view of the attachment arm depicting its ability to rotate about a horizontal axis.

FIG. 5*b* is a top plan view of the attachment arm depicting its ability to pivot about a vertical axis according to an embodiment of the invention.

DETAILED DESCRIPTION

Figure 1:
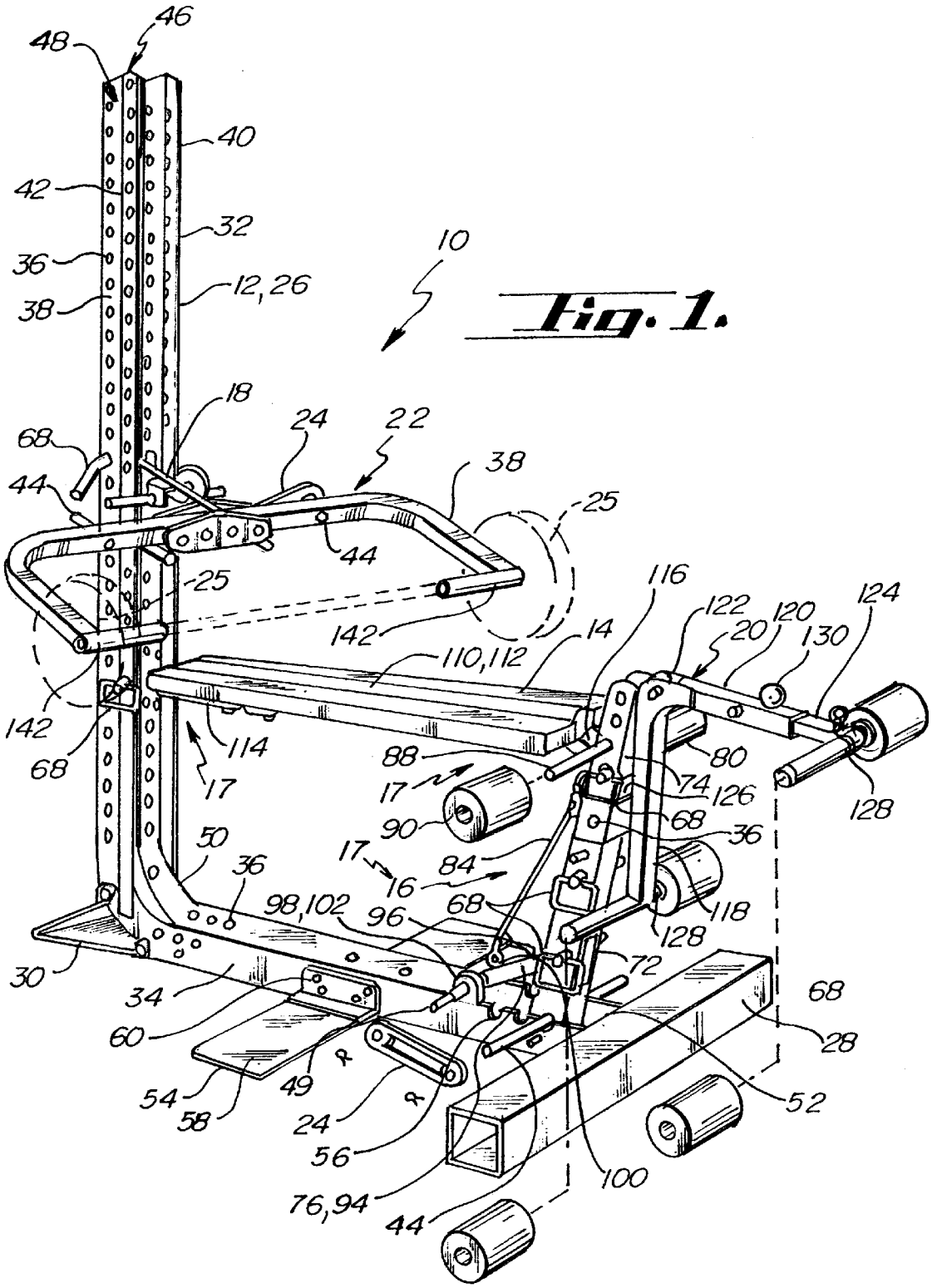
FIG. 1 is a perspective view of the exercise apparatus according to an embodiment of the invention.

An exercise apparatus generally designated as 10 is shown in FIG. 1. Apparatus 10 comprises exercise frame 12, bench unit 14, leg unit 16, universal attachment arm 18, leg exercise unit 20, and an arm exercise component 22. Exercise apparatus 10 utilizes elastomer bands 24 to provide the desired resistance force which may be supplemented by additional weights. Elastomer bands 24 are commonly known and used in the industry and therefore will not be discussed in detail.

In one embodiment of the invention shown in FIG. 1, exercise frame 12 generally comprises channel member 26, transverse stabilizer bar 28, and heal support 30. Channel member 26, preferably constructed of steel, comprises vertical channel portion 32, horizontal channel portion 34, and attachment apertures 36. Vertical channel portion 32 resists twisting by incorporating a narrow channel portion 38 and wide channel portion 40 with a chamfered portion 42 connecting them. Vertical channel portion 32 has a plurality of attachment apertures 36 used to connect bench unit 14 and universal attachment arm 18, and to further provide support for band support pins 44 and to adjust the tension of elastomer bands 24. Apertures 36 on vertical channel portion 32 are preferably aligned in front and rear vertical columns 46 and 48, respectively.

Horizontal channel portion 34 is preferably integral with vertical channel 32 and contains attachment apertures 36 which are positioned to facilitate the attachment of: heal support 30 at the rear 50 of horizontal channel portion 34; transverse stabilizer bar 28 at the front 52 of horizontal channel portion; the optional transverse stabilizer wings 54; bench unit 14 and leg unit 16. Additional apertures 36 are provided to accommodate various positions of bench unit 14 and leg unit 16. Shoulder portions 56 are positioned at the top edge and toward the front 52 of horizontal channel portion 34 to further accommodate in the positioning of leg unit 16. Generally, the attachment of the various exercise components is accomplished using nuts and bolts, pins, or any other suitable fastening technique. Transverse stabilizer wings 54 provide additional support to prevent frame 12 from tipping. Each stabilizer wing 54 has a horizontal planar member 58 which contacts the flow and a wing connecting portion 60 which attaches to horizontal channel portion 34.

A second embodiment of exercise frame 12 is shown in FIG. 2. In this embodiment, horizontal channel portion 34 is replaced with horizontal bar 62 comprised of square tubing which has a curved portion at its read in which the bottom end of vertical channel portion 32 is inserted. Bench connecting portion 64 consisting of a channel portion 66 having aligned attachment apertures 36 for attaching bench unit 14 to frame 12 is located on the top of horizontal bar 62 near the rear. Heal support 30 and transverse stabilizing bar 58 are used to prevent frame 12 from tipping. Leg unit 16 can be attached to horizontal bar 62 at its front end using pins 68. One pin 68 is inserted through one of the tubes 70 welded to the top of horizontal bar 62. A second pin 68 is inserted in one of the provided apertures 36 so that leg unit 16 is positioned at the desired angle.

Figure 3:
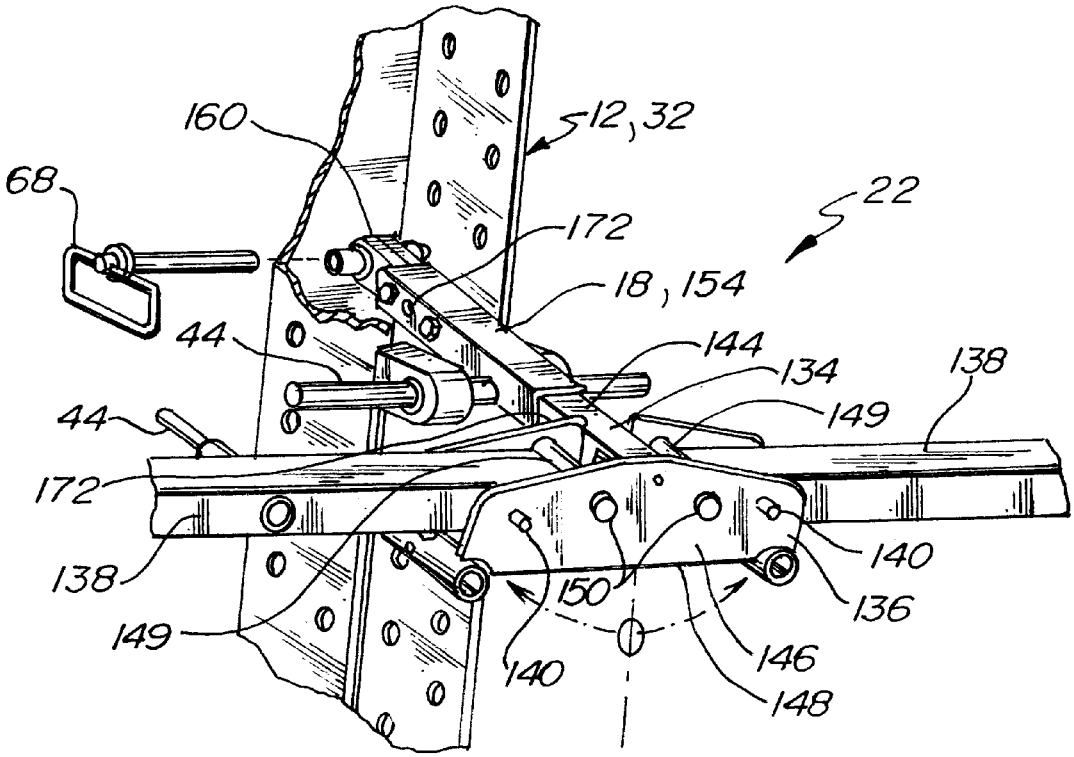
FIG. 3 is a perspective view of the multi-exercise component attached to the exercise frame.

Referring to FIGS. 1, 2, and 3, leg unit 16, including a forward upright support post 71, provides support for bench unit 14 and leg exercise unit 20 and generally comprises lower channel member 72 and upper channel member 74. Lower channel member 72 attaches to horizontal channel portion 34 and supports upper channel member 74 and resistance member 76. Apertures 36 and pins 68 are used to secure upper channel member 74 and to rotatably attach resistance member 76 to lower channel member 72. Lower channel member 72 connects to horizontal channel portion 34 with a pins 68 and a band support pin 44. Upper channel member, shown in FIGS. 1 and 2 supports bench unit 14 and leg exercise unit 20 and has connecting portion 78 consisting of a more narrow channel portion relative to lower channel member 72 which can be inserted within lower channel member 72. Upper channel member 74 utilizes apertures 36 to facilitate securing connecting portion 78 within lower channel member 72, and attaching bench unit 14 and padded leg support 80.

Cord guide 82, used to guide cord 84 used with leg exercise unit 20, is secured above connecting portion 78 and within upper channel member 74. Preferably, cord guide 82 is rotating grooved disk. Opening 86, located on the front side of upper channel member 74, allows cord 84 to access cord guide 82. Padded leg support 80 generally comprises a bar portion 88 which, is inserted through apertures 36 of upper channel member 74 and cylindrical pads 90 which attach at the ends of the bar portion and secure it in place. Padded leg support 80 is used to support the knee area of the user's legs while using the leg exercise unit. Connecting ring 92 located at the top of upper channel member 74 is used to pivotally attach leg exercise unit 20.

Resistance member 76 comprises lever arm 94 having a connector end 96 and a band end 98, cord connector 100, band support pin 44, and rubber stoppers 102. Connector end 96 utilizes an aperture 36 to rotatably connect to lower channel member 72 as discussed above. Lever arm 94 extends between connector end 96 and band end 98. Band support pin 44 extends through band end 98 and is used to support one end of elastomer band 14. Rubber stoppers 102 connect around band support pin 44 and restrict the downward movement of resistance member 76 to the top of horizontal channel portion 34. Cord connector 100, depicted as a vertically oriented hoop, is used to attached cord 84 of leg exercise unit 20 to resistance member 76. To create the desired resistance, elastomer bands 24 are attached to the band support pins 44 of resistance member 76 and lower channel member 72. Further adjustment of the resistance and the range of leg exercise unit 20 can be accomplished by adjusting the position of connector end 96 on lower channel member 72.

One embodiment of lower channel member 72, shown in FIG. 1, connects within horizontal channel portion 34 using pin 68 and band support pin 44. Pin 68 is inserted through aperture 36 of horizontal channel portion 34 and corresponding aperture 36 of lower channel member 72 thereby rotatably connecting lower channel member 72 to horizontal channel portion 34. Band support pin 44 is inserted through an aperture 36 of lower channel member and rests within the desired shoulder portion 56 of horizontal channel portion 34 to fix the position of lower channel member 72. The angle and position of lower channel member 72 can be adjusted according the user's desires through selection of the appropriate apertures 36.

FIG. 2 shows a second embodiment of lower channel member 72 which corresponds with the second embodiment of frame 12. In this embodiment lower channel member 72 utilizes link connector 104 to attach lower channel member 72 to horizontal bar 62. Link connector 104 has an upper aperture 106 positioned above an oval aperture 108. Pins 68 are inserted through upper aperture 106 and oval aperture 108 and through the corresponding apertures 36 of horizontal bar 62 to attached lower channel member 72 in the desired position.

Bench unit 14 is shown in FIG. 1 in its traditional horizontal position, but may be adjusted from a 30° decline to a 45° incline. Bench 100 comprises rigid planar support member 110 having a cushioned surface 112, rear connecting bar 114, and front connecting bar 116. Rear connecting bar 114 has apertures 36 which correspond with apertures 36 of vertical channel portion 32 to facilitate connecting of bench 100 to frame 12. Rear connecting bar 114 pivotally and removably connects within vertical channel portion 32 at either front vertical column 46 or rear vertical column 48 of apertures 36, or at the rear of horizontal channel portion 34 using connecting pin 68. Front connecting bar 116 has apertures 36 which can be aligned with an aperture 36 of upper channel member 74 or lower channel member 72 depending on the position of bench 100 the user desires.

Leg exercise unit 20, shown in FIG. 1, comprises: leg extension bar 118; leg curl bar 120 having two aligned apertures 36; elbow connector portion 122 having aligned apertures 36; elbow connector portion 122 having aligned apertures 36; telescoping bar 124; cord connector 126; and padded bars 128. Leg extension bar 118 and leg curl bar 120 attached to elbow connector portion 122 and are perpendicular to each other. Elbow connector portion 122 pivotally attaches to connector ring 29 by way of inserting a bolt through apertures 36 of elbow connector portion 122 and securing it with a nut. Alternative methods for attaching elbow connector portion 122 to ring connector 92 are available such as a pin or other suitable connector having a shaft about which elbow connector portion 122 may rotate. Telescoping bar 124 is partially contained within leg curl bar 120 and has two aligned apertures (not shown) that correspond with the aligned apertures 36 of leg curl bar 120 allow for locking pin 130 to be inserted through leg curl bar 120 and telescoping bar 124 to prevent the further extension of telescoping bar 124. Padded bars 128 attach at the ends of telescoping bar 124 and leg extension bar 118 and have detachable cylindrical pads 90 which provide a comfortable surface for the user's legs to contact while performing the leg exercise. Cord 84 attaches to leg extension bar 118 with cord connector 126. After properly arranging bench 100 and attaching cord 84 for using leg exercise unit 20, the user must attach one or several elastomer bands 16 between the band support pins of resistance member 76 and lower channel member 72 to get the desired resistance for the exercise.

Leg exercise unit 20 can be adjusted so that almost any user can use the unit comfortably. Bench 100 and padded leg support 80 can be raised or lowered at upper channel member 74 to adjust for the length of the user's leg for conducting a leg extension exercise. Adjustments can also be made to the amount telescoping bar 124 extends to accommodate a variety of users for conducting a leg curl exercise.

Multi-exercise unit 22, shown in FIGS. 1 and 3, provides the user with the option of configuring it to be used as a press-bar or a butterfly apparatus. Multi-exercise unit 22 generally comprises: universal connector portion 134; support channel 136; push bars 138; band support pins 44; locking pins 140; and handles 142. Universal connector portion 134 is configured to attach universal attachment arm 18 to facilitate connecting multi-exercise unit 22 to vertical channel portion 32 of frame 12. Universal connector portion 134 is generally a square tube which connects to and extends from the middle of support channel 136. Universal connector portion 134 has receiving end 144 for receiving and connecting to universal attachment arm 18. Vertical side walls 146 and base 148 form support channel 136 which contains rotatable ends 149 of push bars 138. Shafts 150 extend through aligned apertures 36 of side walls 146 and bores 152 (not shown) of rotatable ends 149 to rotatably attach push bars 138 to support channel 136. When inserted properly, locking pins 140 extend through additional aligned apertures 36 of side walls 146 and through corresponding aligned apertures 36 (not shown) of push bars 138.

With locking pins 140 inserted, push bars 138 are locked in the horizontal position shown in FIG. 1 and operate as a press-bar and can be used for performing various exercise such as, the bench press, the overhead press, and many other exercises which generally require a fixed bar. In addition, a bar may be inserted through handles 142 to allow the user to perform exercises which require the hands to be in close proximity to each other. When push bars 138 are not locked with locking pins 140, multi-exercise unit 22 operates as a butterfly apparatus allowing push bars 138 to rotate in a vertical plane about shafts 150 thereby allowing the user to perform various exercises requiring the butterfly motion.

Band support pins 44 are positioned along the length of push bars 138 and adjacent the ends of wing support channel near base 148. The user can adjust the resistance to the butterfly motion by positioning elastomer bands 24 around these band support pins 44. Resistance for using multi-exercise unit 22 in its press-bar configuration is accomplished by connecting elastomer bands 24 to band support pins 44 of universal attachment arm 18.

Figure 4:
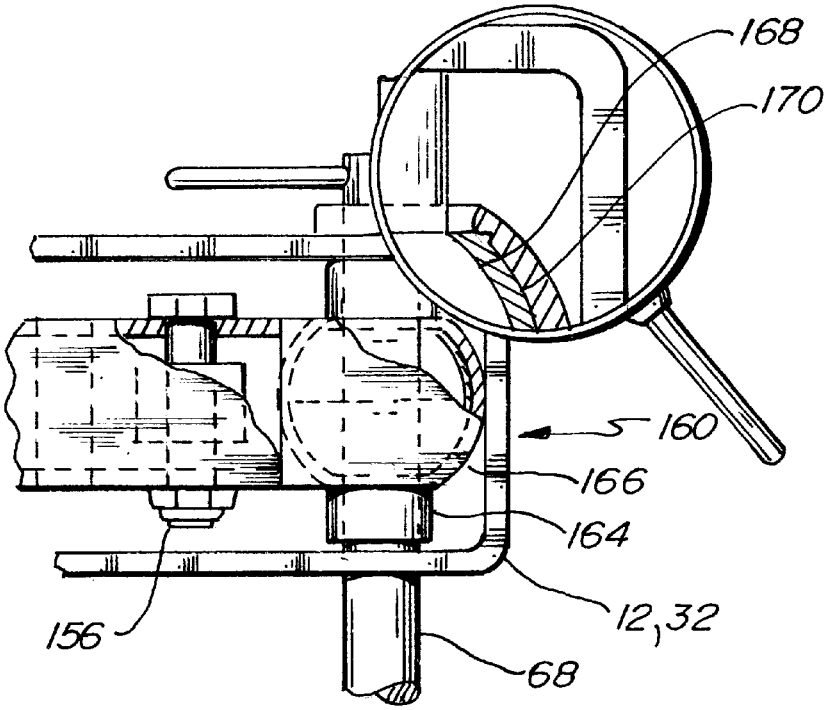
FIG. 4 is a top plan view in partial cross section of the attachment arm attached to the exercise frame according to an embodiment of the invention.

Universal attachment arm 18 is envisioned to be compatible with many exercise units, such as arm exercise unit 22 as shown in FIGS. 1 and 3, to eliminate redundant components, to reduce the weight of exercise components, and to make the setting up of exercise apparatus 10 easier. In addition, universal attachment arm 18 provides a range of motion that provides a more natural lifting experience. Universal attachment arm 18 comprises lever bar 154 having component connecting end 156 and coupling end 158, pivotable coupling 160, and band support 162 as shown in FIGS. 4, 5*a*, and 5*b*. Component connecting end 156 of lever bar 154 can be attached to a compatible exercise component by inserting it into the corresponding receiving end of the component. A pin is used to secure the connection. Band support 162 is connected to lever bar 154 and comprises band support pin 44 for holding an end of an elastomer band 14 and rubber stoppers 102 which protect frame 12 and restrict the movement of lever bar 154. An additional band support pin 44 (not shown) must be inserted through aligned apertures 36 of vertical channel portion 32 to attached elastomer bands 24 so that the desired resistance to vertical motion can be applied to lever bar 154.

Pivotable coupling 160 attaches to coupling end 156 of lever bar 154 and generally comprises bubble shaft 164 and socket portion 166. Bubble shaft 164 is contained within socket portion 166. The exterior surface 168 of bubble shaft 164 conforms with and slideably engages interior surface 170 of socket portion 166. Bubble shaft 164 and socket portion 166 are inserted within vertical channel portion 32 and aligned with corresponding apertures 36 of rear vertical column 48 of frame 12 to allow pin 68 to be inserted through shaft 164 to secure pivotable coupling to frame 12 as shown in FIG. 4. It is envisioned that exterior surface 168 of bubble shaft 164 and interior surface 170 of socket portion 166 are coated with a non-stick material to reduce friction between the surfaces. It is further envisioned that pivotable coupling 160 could be formed from as a ball and socket coupling to provide an even greater range of motion.

Generally, it is desirable for universal attachment arm 18 to be allowed to pivot, swing, or rotate about pivotable coupling 160 when using an exercise component as a press-bar. However, there are times when it is desirable that universal attachment arm 18 remain in a fixed position. This is accomplished by inserting locking pin 172 through aperture 36 of lever bar 154 and aligned apertures 36 of front vertical column 46 of frame 12. This is the desired arrangement when arm exercise unit 22 is configured for a butterfly motion.

FIGS. 3, 5*a* and 5*b* depict the planes within which universal attachment arm 18 may pivot, swing, and rotate when locking pin 172 is not inserted. FIG. 3 shows how universal attachment arm 18 may swing about the axis of lever bar 154. FIG. 5*a* shows how, in one configuration, universal attachment arm 18 may rotate about the horizontal axis aligned with bubble shaft 164. FIG. 5*b* shows how universal attachment arm 18 may swing about a vertical axis aligned with the center of the bubble portion of bubble shaft 164 or socket portion 166.

To accommodate for other types of exercises where it is desirable to have bench unit 14 removed and a flat horizontal surface, platform 174, depicted in FIG. 2, may be used. Platform 174 generally comprises legs 176 and rigid planar base 178. Legs 176 are designed to maintain base 178 above horizontal channel portion 34, but it may use horizontal channel portion 34 as additional support for base 178. Base 178 connects to each leg 176 and may be made from steel, plastic, or other sufficiently stiff material.

Various configurations of exercise apparatus 10 along with example of exercises that can be performed on exercise apparatus 10 are shown in the attached Appendix.

The present invention may be embodied in other specific forms without departing from the spirit or essential attributes thereof, and it is therefore desired that the present embodiment be considered in all respects as illustrative and not restrictive.

What is claimed is:

1. An exercise apparatus for performing multiple exercises, the apparatus comprised of a support structure with a forward end and a rearward end, a leg exercise unit attached to the support structure at the forward end, and an arm exercise unit attached to the support structure at the rearward end, the support structure comprising a forward upright support post, a rearward upright support rail, a lower horizontal support member extending between the forward post and rearward rail, the lower horizontal support member fixed to the rearward upright rail, the lower horizontal support member having a plurality of horizontally differentiated mounting positions for receiving the forward post, a bench unit extending between the forward post and the rearward rail and positioned above the lower horizontal support, the bench unit pivotally mountable at a plurality of vertically differentiated positions on the rearward rail and pivotally mountable at a plurality of vertically differentiated positions on the forward post, whereby the support structure is generally quadrilaterally shaped with a multitude of bench positions for performing arm exercises on the arm exercise unit and leg exercise on the leg exercise unit.

2. The exercise apparatus of claim 1 wherein the leg exercise unit is mountable on the forward end at the plurality of vertically differentiated positions.

3. The exercise apparatus of claim 1 wherein the arm exercise unit comprises an attachment portion connectable at the plurality of mounting positions on the rearward rail whereby the arm exercise unit is vertically adjustable thereon, the attachment portion extending from the rearward rail forwardly to a branch portion, a pair of arm handle portions each extending laterally from the branch portion.

4. The exercise apparatus of claim 3, wherein arm handle portions are foldable inwardly at the branch portion for providing a folding butterfly motion, a pair of elastomer bands attachable to each of the arm handle portions to provide resistance in the butterfly motion, the arm handle portions lockable to prevent the butterfly motion whereby the arm handle portions may function as a press bar for press exercises.

5. The exercise apparatus of claim 3 wherein the attachment portion is pivotally mountable to the rearward rail for providing a vertical motion of the arm handle portions with the arm handle portions at a fixed distance between each other, and wherein an elastomeric band is attachable between the rearward rail and the attachment portion for providing resistant as the arm handle portions are moved in the vertical motion.

6. The exercise apparatus of claim 1, wherein the bench is disconnectable to the forward post and mountable to the lower horizontal support member.

7. An exercise apparatus for performing multiple exercises, the apparatus comprised of a support structure with a forward end and a rearward end, an exercise unit attached to at least one of the forward end and rearward end, the support structure comprising a forward upright support post, a rearward upright support rail, a lower horizontal support extending between the forward post and rearward rail, the lower horizontal support member fixed to the rearward upright rail, the horizontal support having a plurality of mounting positions for receiving the forward post, the mounting positions providing a plurality of angular positions of the forward post, and a bench unit extending between the forward post and the rearward rail and positioned above the lower horizontal support, the bench having a plurality of vertically differential pivotal mounting positions on the forward post and a plurality of vertically differentiated pivotal mounting positions on the rearward upright rail, whereby the support structure is generally quadrilaterally shaped with a multitude of bench positions for performing exercises on the exercise unit.

8. The exercise apparatus of claim 7, wherein the exercise unit comprises an attachment portion connectable at the plurality of mounting positions on the rearward rail, the attachment portion extending from the rearward rail forwardly to a branch portion, a pair of arm handle portions each extending laterally from the branch portion.

9. The exercise apparatus of claim 8, wherein arm handle portions are foldable inwardly at the branch portion for providing a butterfly motion, a pair of elastomer bands attachable to each of the arm handle portions to provide resistance in the butterfly motion.

10. An exercise apparatus for performing multiple exercises, the apparatus comprised of a support structure with a forward end and a rearward end, an arm exercise unit attached to the support structure at the rearward end:

the support structure comprising a forward upright support post, a rearward upright support rail, a bench unit extending between the forward post and the rearward rail;

the arm exercise unit comprising an attachment portion connectable at the plurality of mounting positions on the rearward rail, the attachment portion extending from the rearward rail forwardly to a branch portion, a pair of arm handle portions each extending laterally from the branch portion;

the attachment portion pivotally, mounted to the rearward rail for providing a vertical motion of the arm handle portions with the arm handle portions at a fixed distance between each other, and wherein an elastomeric band is attachable between the rearward rail and the attachment portion for providing resistance as the arm handle portions are moved in the vertical motion for press exercises, the attachment portion lockable at the rearward rail to stop pivoting at the mounting of the attachment portion to the rearward rail whereby the arm exercise unit may be used for butterfly motion exercises; and the arm handle portions are independently inwardly foldable at the branch portion for providing a butterfly motion, a pair of elastomer bands attachable to each of the arm handle portions to provide resistance in the butterfly motion, each of the arm handle portions independently lockable to stop the butterfly motion for use of the arm handles in press exercises.

11. The exercise apparatus of claim 10, wherein the attachment portion is lockable in a plurality of angular positions with respect to the rearward rail.

12. The exercise apparatus of claim 10 wherein the attachment portion comprises a bubble shaft and a socket portion engaged therewith.

13. The exercise apparatus of claim 10, wherein the support structure further comprises a lower horizontal support member extending between the forward post and rearward rail, the lower horizontal support post fixed to the rearward upright rail, the horizontal support member having a plurality of mounting positions for receiving the forward post, a bench unit extending between the forward post and the rearward rail and positioned above the lower horizontal support, the bench unit mountable at a plurality of vertically differentiated positions on the rearward rail, the bench unit mountable at a plurality of vertically differentiated positions on the forward post, whereby the support structure is generally quadrilaterally shaped with a multitude of bench positions for performing arm exercises on the arm exercise unit and leg exercises on the leg exercise unit.

14. An exercise apparatus for performing multiple exercises, the apparatus comprised of a support structure with a forward end and a rearward end, an arm exercise unit attached to the support structure at the rearward end:

the support structure comprising a forward upright support post, a rearward upright support rail, a bench unit extending between the forward post and the rearward rail;

the arm exercise unit comprising an attachment portion connectable at the plurality of mounting positions on the rearward rail, the attachment portion comprising a ball and socket joint and extending from the rearward rail forwardly to a branch portion, a pair of arm handle portions each extending laterally from the branch portion; the attachment portion pivotally connected at the ball and socket joint for providing a vertical motion of the arm handle portions with the arm handle portions at a fixed distance between each other, and wherein an elastomeric band is attachable between the rearward rail and the attachment portion for providing resistance as the arm handle portions are moved in the vertical motion.

15. The exercise unit of claim 14, wherein, the attachment portion lockable at the rearward rail to stop pivoting at the mounting of the attachment portion to the rearward rail; and the arm handle portions are independently inwardly foldable in a branch portion for providing a butterfly motion of the arm handle portions, a pair of elastomer bands attachable to each of the arm handle portions to provide resistance in the butterfly motion, each of the arm handle portions independently lockable to stop the folding motion.

* * * * *